US006243324B1

(12) United States Patent
Teng

(10) Patent No.: US 6,243,324 B1
(45) Date of Patent: Jun. 5, 2001

(54) UNIVERSAL DIGITAL TIME DISK

(76) Inventor: Ching-Shih Teng, 5F, No. 6, Lane 79, Shioufeng Street, Junghe City, Taipei Hsien (TW)

( * ) Notice: Subject to any disclaimer, the term of this patent is extended or adjusted under 35 U.S.C. 154(b) by 0 days.

(21) Appl. No.: 09/456,934

(22) Filed: Dec. 7, 1999

(51) Int. Cl.[7] ..... G04B 19/22
(52) U.S. Cl. ..... 368/21; 368/27
(58) Field of Search ..... 368/21, 23, 27

(56) References Cited

U.S. PATENT DOCUMENTS 641,540 * 1/1900 Pheils ..... 368/27
2,103,656 * 12/1937 Willis ..... 368/27
2,268,239 * 12/1941 Braaten ..... 368/27

* cited by examiner

*Primary Examiner*—Vit Miska
(74) *Attorney, Agent, or Firm*—Pro-Techtor International Services

(57) ABSTRACT

A universal digital time disk is printed on its central portion with name of places on behalf of the known 24 time zones in the world, and on its next outer zone with name of four continents: the Australia, the Asia, the Europe and Africa, and the America for quick index. Further, on an outer zone next to the continents, the ordinal numbers from 1 through 24 are marked for a user to rapidly check time of a desired time zone with a given ordinal number and realize date difference between two places in the world on the basis that all the time zones included in the area between a first time zone of the day of exchange and the position of the twenty-fourth hour in a minute/second zone date the same while the rest is one day before.

2 Claims, 5 Drawing Sheets

UNIVERSAL DIGITAL TIME DISK

BACKGROUND OF THE INVENTION

1. Field of the Invention

This invention relates to a universal digital time disk, particularly to a disk printed with 24 time zones and name of 4 continents in its central portion, as well as ordinal number of each time zone in its outermost annulus for a quick reference to me and date in each zone.

2. Description of the Prior Art

Whereas an average universal watch is usually printed with name of places on behalf of the 24 time zones in the world on its outer frame that people have to spend a lot of time in searching for a desired time zone wordwise and discriminate its date difference, hence, the inventor of this invention is to propose an improved digital time disk for eliminating abovesaid inconvenience.

SUMMARY OF THE INVENTION

The primary object of this invention is to provide a universal digital time disk, wherein 24 time zones and two special time zones—the India and the Iran time zone, plus 4 continents—the Australia, the Asia, the Europe and Africa, and the America divided according to geographical locations are printed in its central portion so that people can immediately find the conspicuous continent where a desired time zone belongs to, then look into the details.

Another object of this invention is to provide a universal digital time disk wherein a round-the-clock minute/second zone is printed on its outer ring so that people can read the time in hour with reference to the continent position to catch the time segment of daylight, nighttime, morning, afternoon, work hours, or duty off, etc. Yet another object of this invention is to provide a universal digital time disk having the ordinal numbers from 1 through 24 printed in an outer rim of the 4-continent column so that a user can distinguish the continental dates immediately by reading the ordinal numbers. For example, the scope including the ordinal number 1 through the number 24 in the minute/second zone means the present day, and the rest means the day before.

BRIEF DESCRIPTION OF THE DRAWINGS

For a better understanding to the present invention, together with further advantages or features thereof, at least one preferred embodiment will be elucidated below with reference to the annexed drawings in which.

DETAILED DESCRIPTION OF THE PREFERRED EMBODIMENT

Figure 1A:
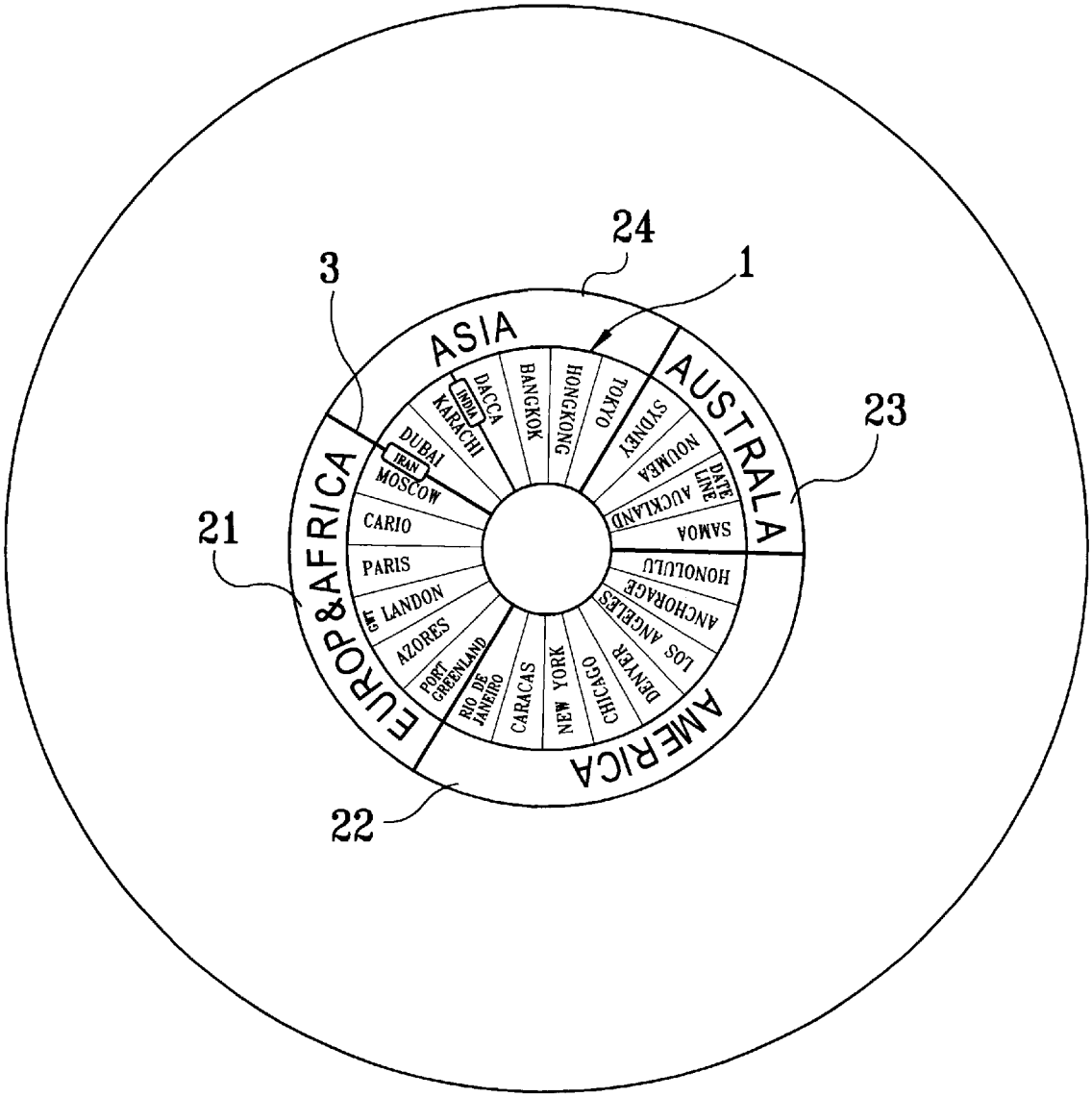
FIGS. 1(A) and 1(B) are schematic partial views of a universal digital time disk of this invention.
Figure 1B:
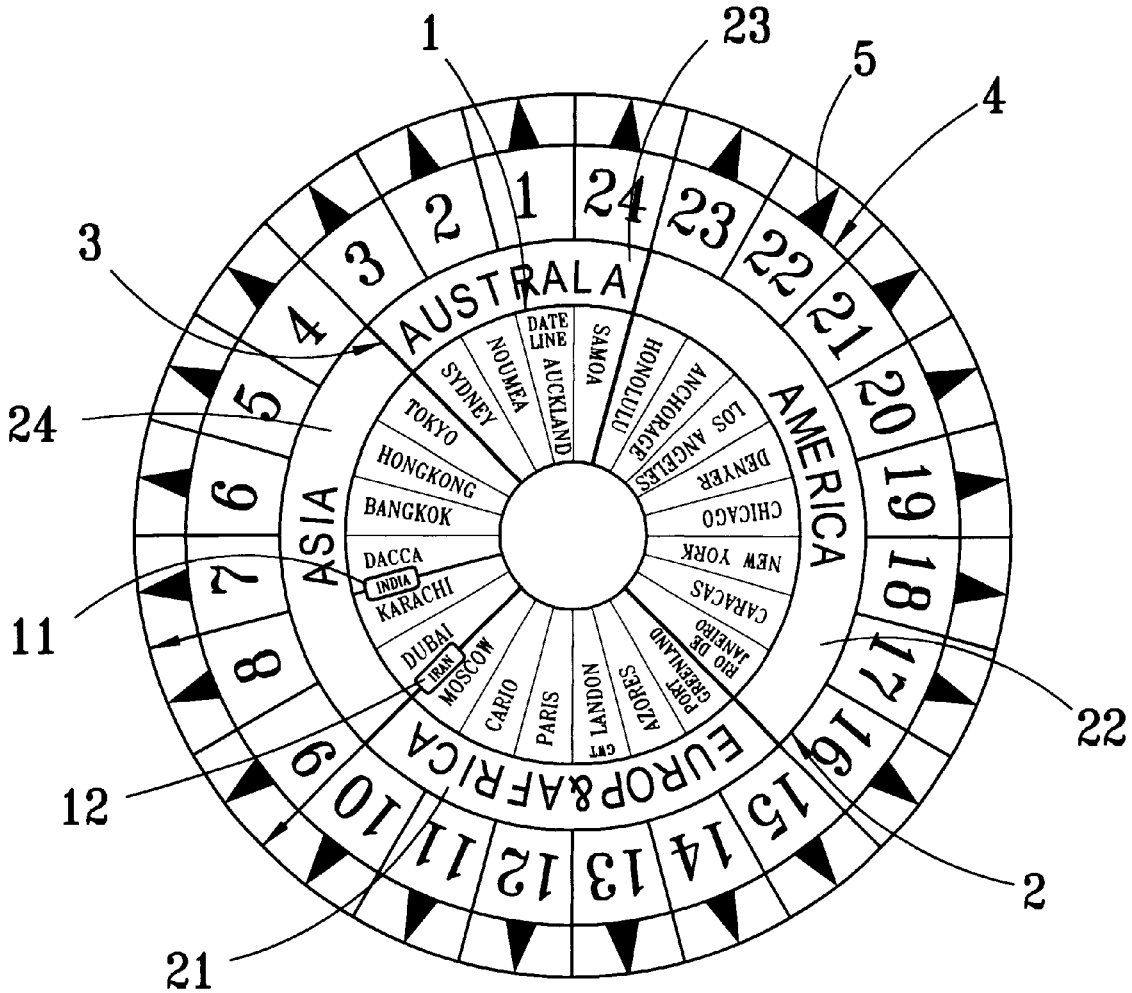
Figure 2:
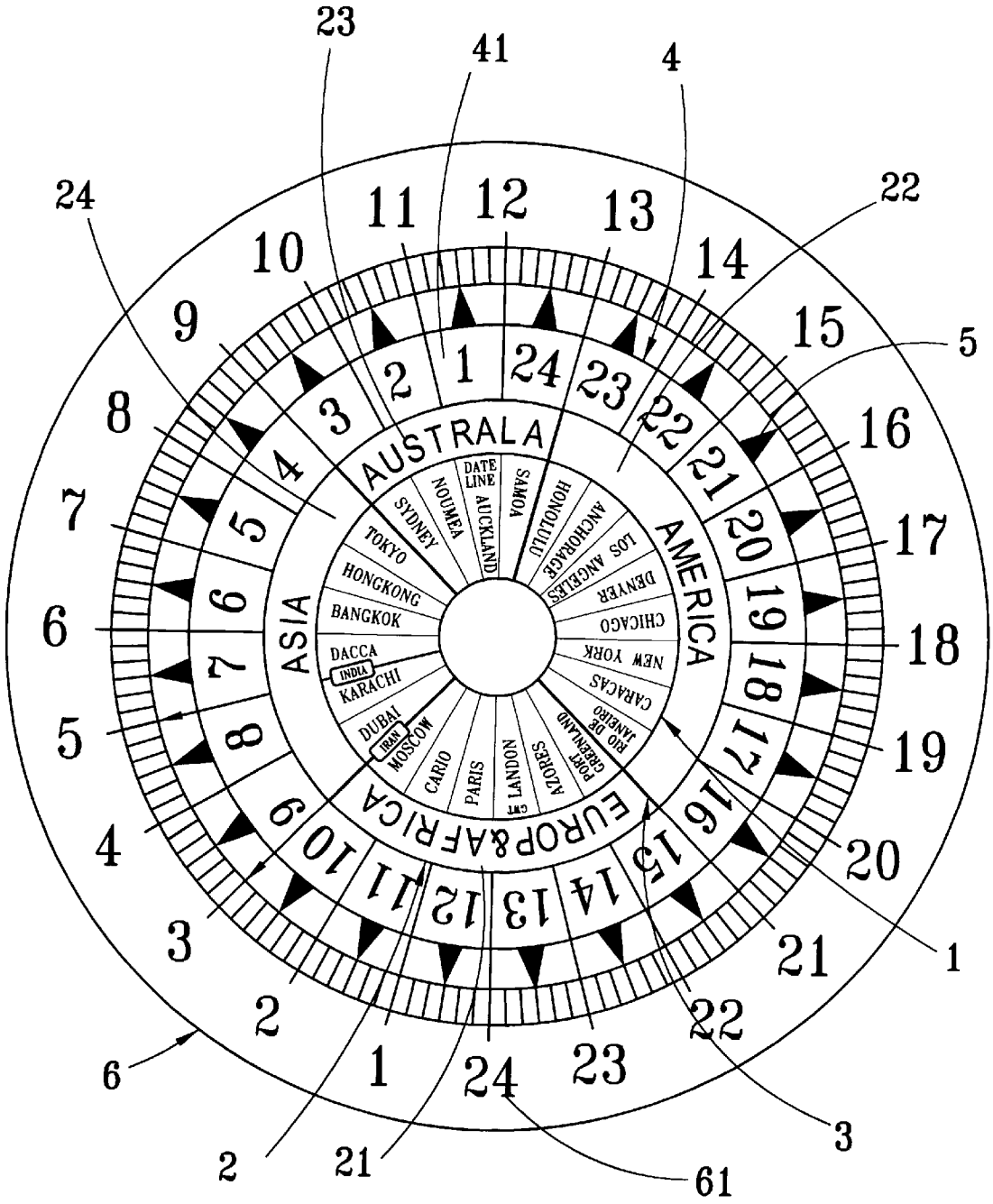
FIG. 2 is a schematic plan view of the universal digital time disk of this invention.

As shown in FIGS. 1(A) and 1(B), the 24 time zones 1 of the world and two special time zones of the Iran 12 and the India 11 are printed radially in central portion of a universal digital time disk of this invention, meanwhile, the time zones 1 are divided into four parts: the Australia 23, the Asia 24, the Europe and Africa 21, and the America 22 in bold lines 3 according to geographical locations, which serve as index for people to find a desired time zone more easily and quickly. Moreover, the outermost ring is programmed as a round-the-clock minute/second zone 6 which is divided into four quadrants for showing four time segments respectively: morning, afternoon, night, and deep night. Therefore, a user may keep informed of work and rest time all over the world on basis of time segments shown in those four quadrants. Along an outer rim enclosing the 4-continent column, the 24 time zones 1 are further divided into 24 Arabic ordinal numbers (1–24) from the day of exchange (Auckland time zone ) by hour stepwise, wherein each number is marked with a triangular pointer 5 pointing at and connecting with an inner rim of the minute/second zone 6. The given ordinal numbers are endued with two functions:

1. The user can read time according to a given ordinal number faster than read wordwise.

2. The user can catch the date of each time zone quickly. The scope from the twenty-fourth hour 61 of the minute/second zone 6 to the ordinal number 1 (time zone 41) in a clockwise path belongs to the present day, and the rest belongs to the day before; and the time disk must be turned 360° clockwise per day.

Figure 3A:
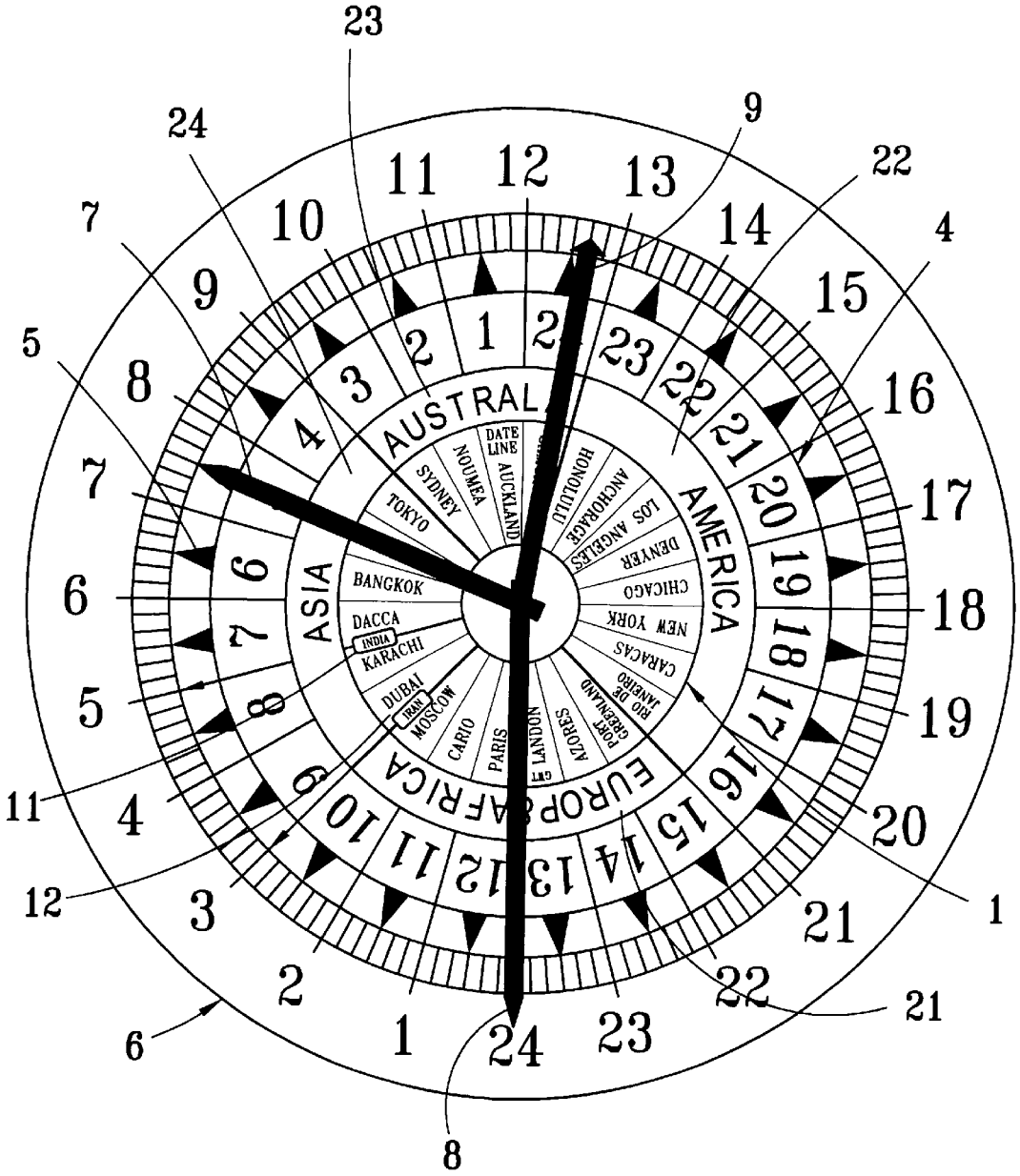
FIGS. 3(A) and 3(B) are embodiments of the universal digital time disk of this invention.
Figure 3B:
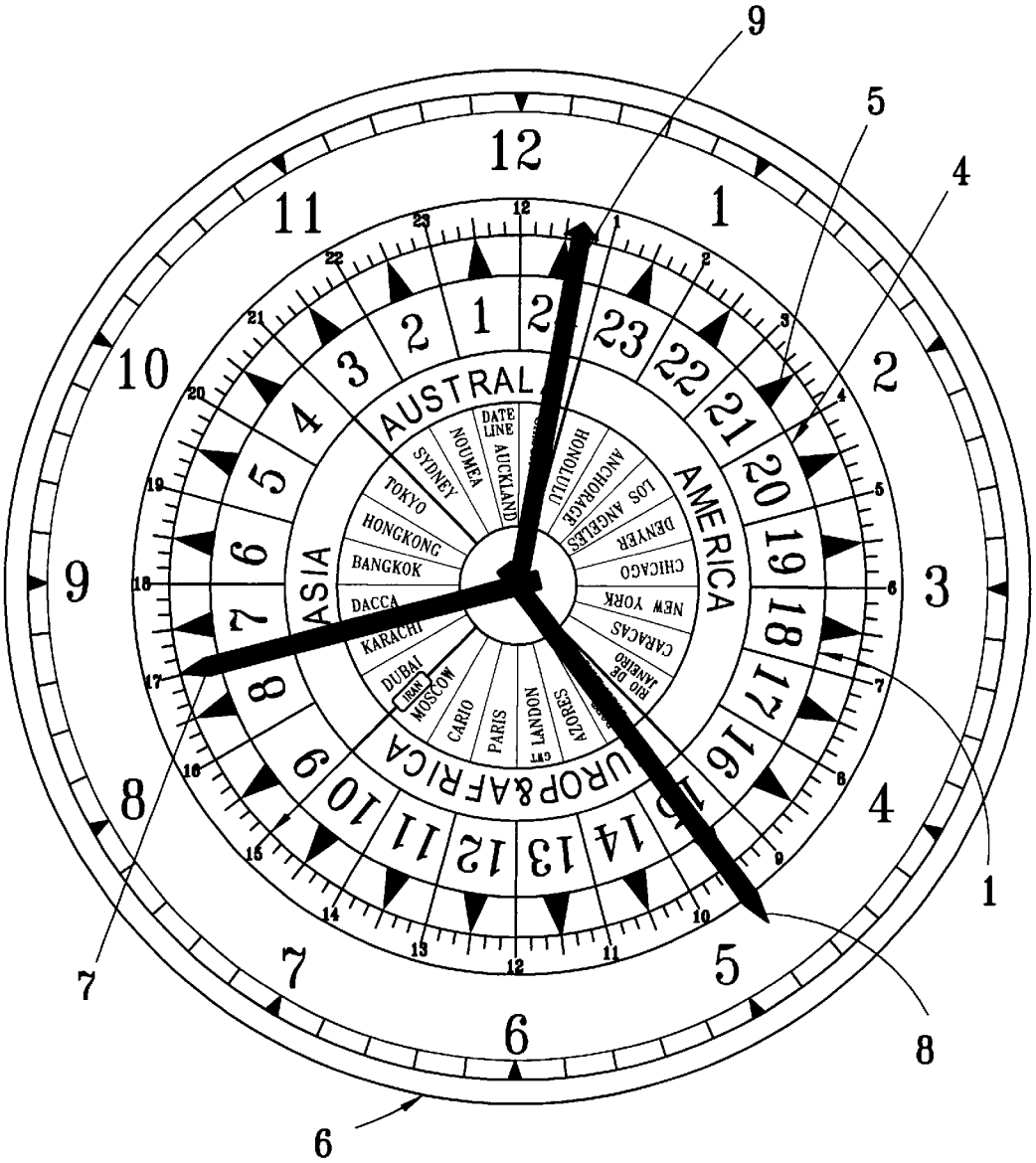

As shown in FIGS. 3(A) and 3(B), the dial is made in 24-hours and 12-hours respectively. Wherein an hour hand 7, a minute hand 8, and a second hand 9 are disposed in the dials for indicating time of the local time zone, and the pointer 5 can be used for observing hour point, minute point, and second point of the rest 23 time zones with the help of the minute hand 8, and a second hand 9. The minute/second zone 6 and the concentric inner time disk may be painted in different colors to avoid visual confusion.

Although, this invention has been described in terms of preferred embodiments, it is apparent that numerous variations and modifications may be made without departing from the true spirit and scope thereof, as set forth in the following claims.

What is claimed is:

1. A universal digital time disk comprising:

a plurality of concentric circular charts; wherein an innermost chart is divided into twenty-four innermost radial sections, said innermost sections representing twenty-four time zones, each said innermost section being designated with an easily recognized landmark included in the time zone represented by said innermost section, said innermost chart further including designations for at least the international date line, the Greenwich meridian, and for time zones in India and Iran, a second chart outside said innermost chart is divided into four second sections, said second sections representing respectively Europe and Africa, Asia, Australia, and America, a third chart outside said second chart is divided into twenty-four third sections, said third sections being numbered one through twenty-four, a fourth chart outside said third chart is divided into twenty-four fourth sections, said fourth sections each include a centered pointing element, a fifth chart outside said fourth chart is divided into one hundred forty-four fifth sections, said fifth sections each represent a ten minute interval, and a sixth chart outside said fifth chart includes equally spaced designations for twenty-four hours; such that a user of said time disk is able to easily and rapidly determine time and date differences between a first reference geographical location and any other desired geographical location.

2. The digital time disk of claim 1 wherein:

a time keeping mechanism is included such that the user is able to rotate said plurality of concentric circular charts relative to said time keeping mechanism so that said desired geographical location is designated by a hand of said time keeping mechanism.

* * * * *